US005627331A

United States Patent [19]

Devitrysmith

[11] Patent Number: 5,627,331

[45] Date of Patent: May 6, 1997

[54] GUITAR HAVING IMPROVED ACCESSIBILITY FOR STRING ATTACHMENT

[76] Inventor: T. John Devitrysmith, 17005 NE. 101 St. Pl., Redmond, Wash. 98052

[21] Appl. No.: 610,857

[22] Filed: Mar. 5, 1996

[51] Int. Cl.[6] ..... G10D 3/14

[52] U.S. Cl. ..... 84/304; 84/267

[58] Field of Search ..... 84/304, 305, 306, 84/293, 267

[56] References Cited

U.S. PATENT DOCUMENTS 4,030,399 6/1977 Grottola ..... 84/304

4,576,080 3/1986 McLellan et al. ..... 84/267

*Primary Examiner*—Michael L. Gellner
*Assistant Examiner*—Shih-yung Hsieh
*Attorney, Agent, or Firm*—Robert W. Jenny

[57] ABSTRACT

The head of the subject guitar is an assembly of a functional portion and a cover. The functional portion includes tuning machines and pickups and the posts of the tuning machines extend from an essentially flat back area of the functional portion so that when the cover is removed the posts are clear of any surrounding structure and fully accessible for removal of the remains of broken strings and for attachment of new strings. The posts are completely enclosed when the cover is installed.

1 Claim, 4 Drawing Sheets

GUITAR HAVING IMPROVED ACCESSIBILITY FOR STRING ATTACHMENT

BACKGROUND OF THE INVENTION

1. Field

The subject invention is in the field of electric guitars and, more particularly, electric guitars which are made as compact as possible while incorporating full scale effective string length. Still more particularly, it is in the field of compact electric guitars in which the knobs for operating the tuning machines extend radially from the front face of the guitar and the posts of the tuning machines, to which the strings are attached, are housed inside the body of the guitar.

2. Prior Art

There are U.S. patents for two guitars which are known to the inventor of the subject invention and are close prior art to the subject invention. One is U.S. Pat. No. 4,576,080 and the second is U.S. Pat. No. 5,485,733, issued Jan. 23, 1996 to the inventor of the subject invention. In the '080 guitar the posts are in a cavity in the back of the body of the guitar and near an edge of the cavity so that the knobs for the tuning machines can extend through a side of the body. In the '773 guitar the string attachment posts are distributed around and near a portion of the perimeter of a cavity in the back of the body of the guitar and the cavity is covered by a cover plate. In both of these guitars the proximity of the posts to an edge surface limits the accessibility of the posts for installation of strings and this is problematic when a string breaks during a performance with a guitar and it is important to replace these broken strings quickly.

Accordingly, the primary objective of the subject invention is to provide a compact electric guitar having improved accessibility to the tuning machine posts for installation of strings. A second objective is that the tuning posts be covered during the use of the guitar so that the exterior of the body of the guitar is smooth and there is no chance of a user of the guitar being pricked or scratched by the ends of installed strings. A third objective is that the tuning posts be easily and quickly uncoverable.

SUMMARY OF THE INVENTION

The subject invention is a compact electric guitar in which the accessibility to the tuning machine posts is improved over that of known prior art guitars. In the subject guitar the strings extend from the end of the neck along the neck, over the front of the body assembly and around the end of the guitar to the posts of the tuning machines. The body assembly of the guitar is hollow and comprises a functional portion and a cover. Part of the back surface of the functional portion is flat and the posts of the tuning machines extend normal to that surface near it's periphery. There may be a low ridge around the periphery of the flat portion. The cover has a rim and fits over the posts with the rim contacting the periphery of the back surface of the functional portion of the body assembly.

The cover is held in place by means which hold it firmly in place when it is installed on the functional portion but allow quick and easy removal and reinstallation of the cover. In a preferred embodiment there is a tongue on the portion of the cover which fits closest to the neck of the guitar and the tongue engages a notch in the functional portion and there is at least one snap fastener elsewhere on the cover. The tongue and fastener fasten the cover to the functional portion. There is at least one protuberance on the surface of the cover to provide a finger grip for applying force to the cover to disengage the snap fastener and allow the cover to be moved to disengage it from the notch, thus removing the cover. Alternately, the cover may be hinged to the functional portion.

When the cover is opened or removed the posts of the tuning machines are fully exposed with improved clearance for removing remnants of a broken string and installing a replacement.

The invention is described in more detail below with reference to the attached drawings.

DETAILED DESCRIPTION OF THE INVENTION

Figure 1:
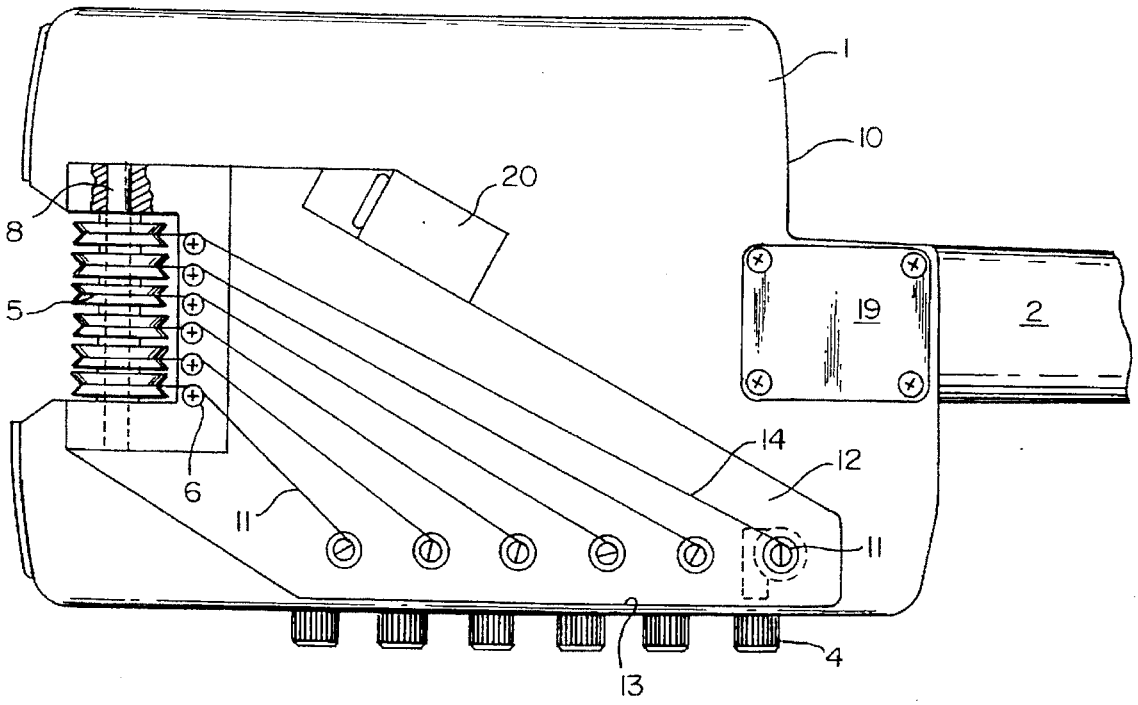
FIG. 1 PRIOR ART
FIG. 1 is a copy of FIG. 1 of U.S. Pat. No. 4,576,080 illustrating the guitar of that patent having tuning machine posts exposed and close to a rim surface.
Figure 2:
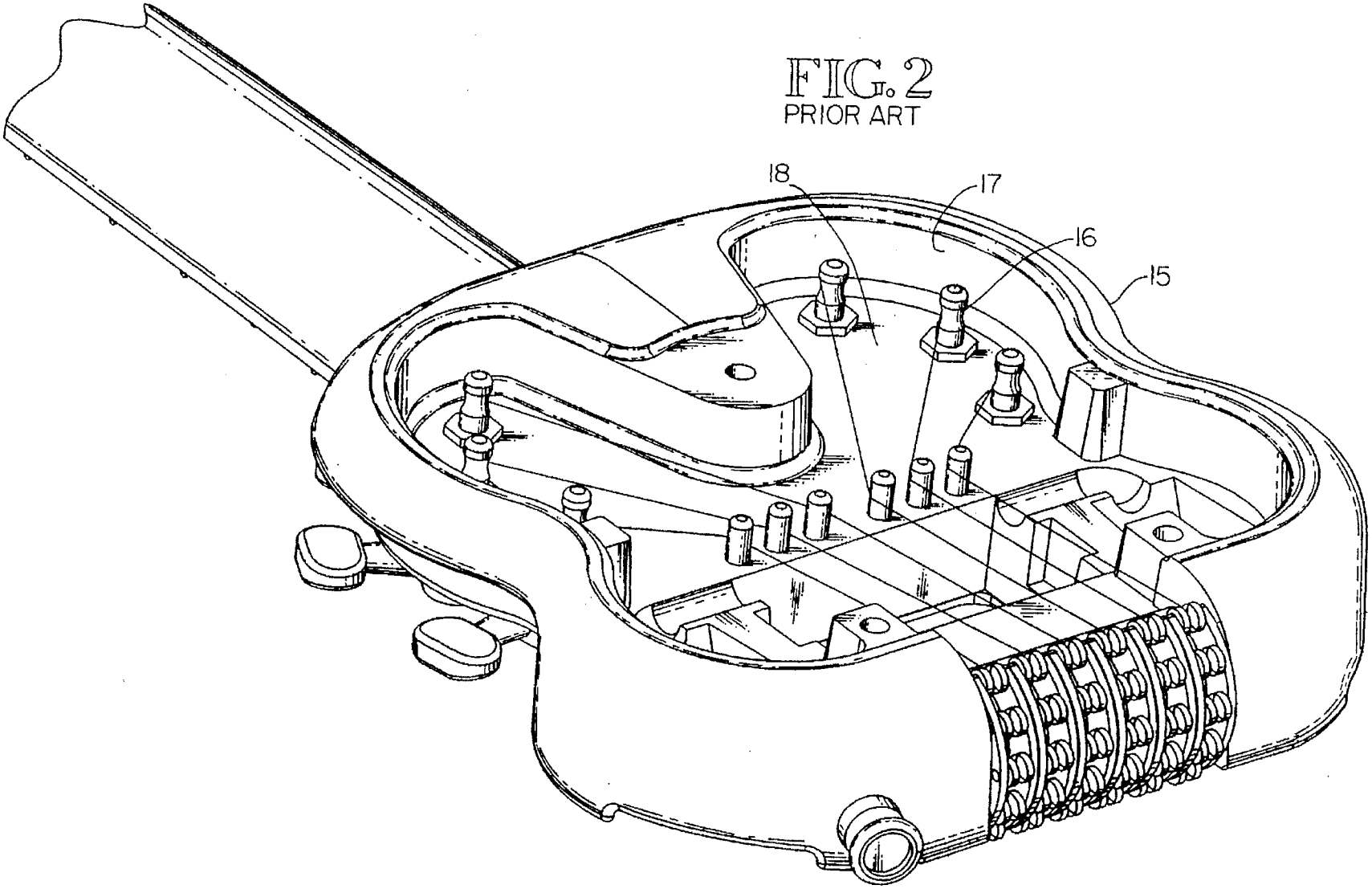
FIG. 2 PRIOR ART
FIG.2 is a copy of FIG. 3 of U.S. Pat. No. 5,485,773 illustrating the body assembly of the guitar of that patent with the back cover removed and showing tuning machine posts close to the periphery of the cavity in the body.
Figure 3:
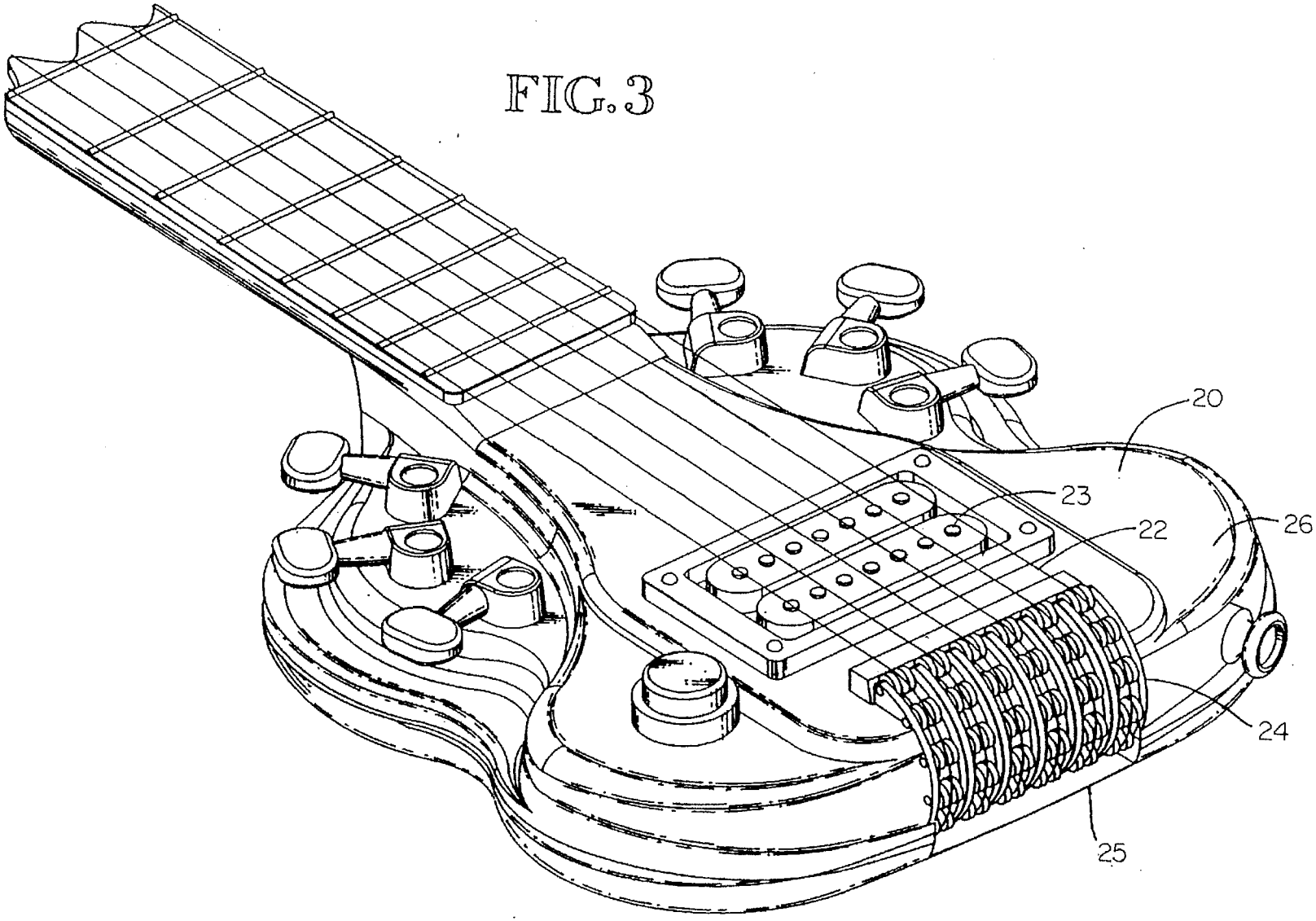
FIG. 3 is a view from the front of the body assembly of the subject guitar.
Figure 4:
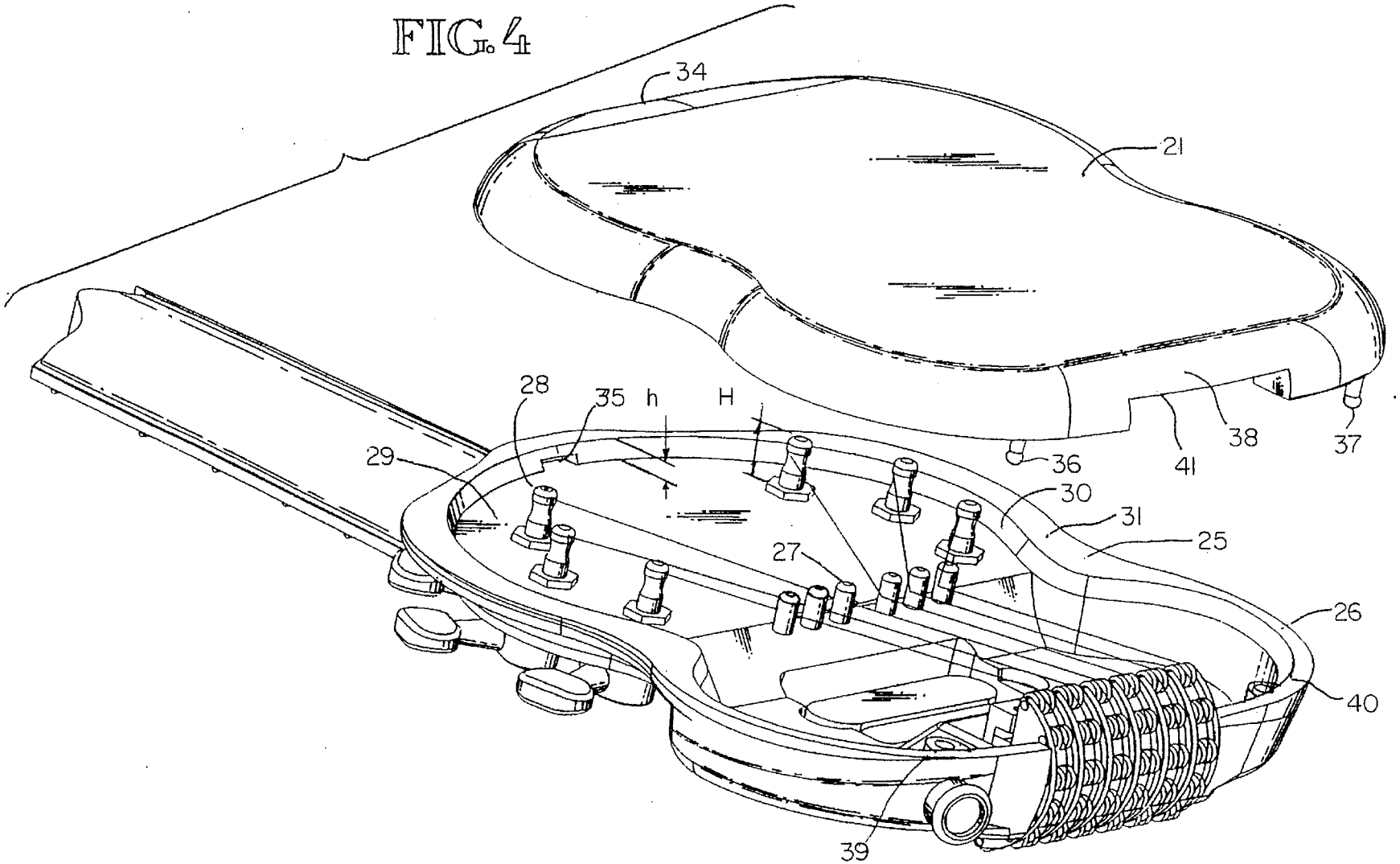
FIG. 4 is a view from the back of the body assembly of the subject guitar with the cover removed.

The subject invention is a compact electric guitar which provides improved accessibility to the posts of the tuning machines of the guitar, with the posts being covered during the use of the guitar. In one prior art guitar 10 in FIG. 1 the posts, post II being typical, are in a cavity 12 and near edge 13 of the cavity. The closeness of the posts to the edge adds to the difficulty of attaching strings, string 14 being typical, to the posts. Similarly, in the prior art guitar 15 in FIG.2 the posts of the tuning machines, post 16 being typical, are close to wall 17 of cavity 18. A flat cover, not shown, covers the cavity. FIG. 3 is a view of the body assembly 20 of the subject guitar from the front showing the strings, string 22 being typical, passing over the pick-ups, pick up 23 being typical, and over carrier assembly 24 to the back of 25 of the functional portion 26 of the body assembly, as shown in FIG. 4, a view of the body assembly from the back with the cover 21 removed. The strings run from the carrier assembly to guide posts, guide post 27 being typical, to the tuning machine posts, post 28 being typical. Surface 29 from which the tuning machine posts extend is flat and surface 30 of rim 31 is at an obtuse angle to surface 29 and rim height h is a fraction of height H of the tuning machine posts with the fraction h/H being in a range of 0 to 0.5.

The cover has a rim 32 which contacts rim 31. There is a tongue 33, not visible in this view, on end 34 of the cover which engages hole 35 in rim 31. Knobbed pins 36 and 37 in end 38 of the cover and receptacles 39 and 40 comprise two snap fasteners by which end 38 is detachably attachable to the functional portion. In use the cover is removed by finger pressure at edge 41 on the cover to disengage the snap fasteners and allow movement of the cover to disengage tongue 33 from hole 35.

It is considered to be understandable from this description that the subject invention meets its objectives. It provides a compact electric guitar having improved accessibility to its tuning machine posts. The tuning posts are covered during the use of the guitar, providing a smooth exterior of the body of the guitar. However, they can be quickly and easily uncovered.

It is also considered to be understood that while one embodiment of this subject invention is described herein, other embodiments and modifications of the one described are possible within the scope of the invention which is limited only by the attached claims.

I claim:

1. A guitar comprising a head assembly, said head assembly further comprising a functional portion and a cover, said functional portion further comprising a plurality of tuning machines and having a back having a flat surface and a rim, said rim having a first height h, said tuning machines having tuning machine posts, said tuning posts extending from said flat surface, each of said tuning posts having a second height H, the ratio h/H being in a range of 0 to 0.5, said cover being detachably attachable to said back surface such that said tuning machine posts are fully enclosed when said cover is attached.

* * * * *